United States Patent [19]

Manley

[11] Patent Number: 4,881,721

[45] Date of Patent: Nov. 21, 1989

[54] FENCE POST AND WEB CONNECTION SYSTEM

[75] Inventor: Jack Manley, Leighton, Ala.

[73] Assignee: Edward S. Robbins, III, Florence, Ala.

[21] Appl. No.: 117,496

[22] Filed: Nov. 6, 1987

[51] Int. Cl.[4] ..... B21F 27/00

[52] U.S. Cl. ..... 256/52; 256/49

[58] Field of Search ..... 256/52, 49, 54, 55, 256/48

[56] References Cited

U.S. PATENT DOCUMENTS

| | | | |
|---|---|---|---|
| 736,147 | 11/1903 | Peterson . | |
| 828,205 | 6/1906 | Glascock . | |
| 830,108 | 9/1906 | Smith | 256/52 |
| 853,846 | 5/1907 | Tyler . | |
| 1,879,725 | 9/1932 | Aiton | 256/52 |
| 3,233,870 | 4/1966 | Gerhardt . | |
| 4,143,859 | 3/1979 | Tews . | |
| 4,465,263 | 4/1984 | Robbins, Jr. . | |
| 4,533,120 | 11/1985 | Ruddock . | |
| 4,684,107 | 8/1987 | Robbins, Jr. . | |

FOREIGN PATENT DOCUMENTS 571196 3/1957 Italy .

*Primary Examiner*—Andrew V. Kundrat

*Attorney, Agent, or Firm*—Nixon & Vanderhye

[57] ABSTRACT

A connector system for attaching one or more flexible fencing webs or rails to fence posts is provided. For each post, at least one elongated, flexible strand, preferably a plastic coated wire, is attached to the post in overlying relationship to the web or rail. The free ends of the strand are firmly fixed to the post by at least a pair of fasteners firmly driven into the post, straddling the strand. Additional fasteners are driven into the post, straddling the strand, at least adjacent upper and lower edges of the web or rail. These fasteners may be driven into the post to a lesser extent, so that the web or rail is constrained against substantially vertical movement, but free to move axially in the direction of its elongation. In one embodiment, the flexible strand comprises a single, plastic coated wire. In another embodiment, the strand comprises a pair of high tensile strength wires ensheathed in a single plastic strip.

26 Claims, 2 Drawing Sheets

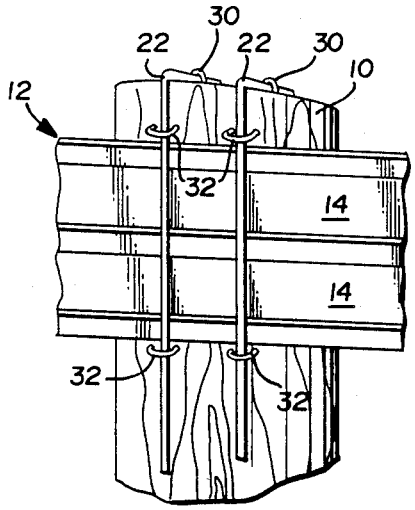
FIG. 4
FIG. 5
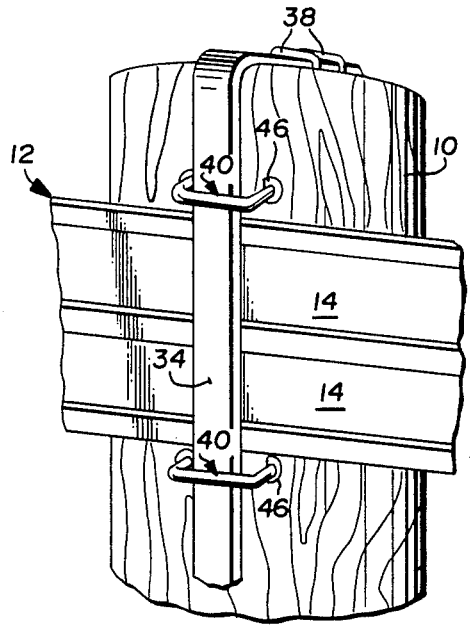
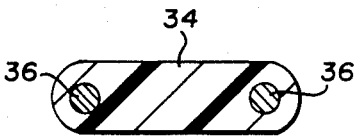
FIG. 6
FIG. 7b
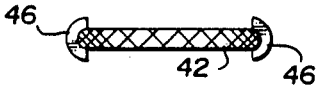
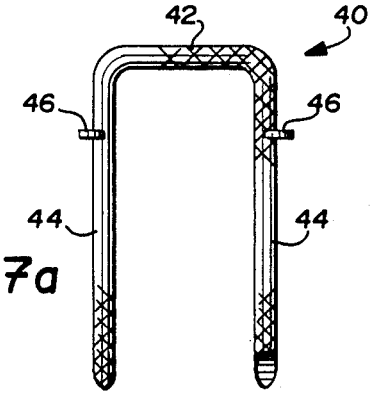
FIG. 7a

FENCE POST AND WEB CONNECTION SYSTEM

BACKGROUND OF THE INVENTION

This invention relates generally to fencing systems and, specifically, to components by which flexible fence webbing material may be secured to individual fence posts.

In U.S. Pat. No. 4,465,263, is disclosed a composite metal and plastic fence wherein at least two high tensile strength metal wires are ensheathed in a plastic casing to form a flexible webbing material which is attached to fence posts with specialized brackets which are configured to accommodate the profile of the webbing material. The brackets are such that the individual fence webs are prevented from any substantial vertical movement on the post, while being free to slide axially in the direction of elongation of the web to permit periodic tensioning of the webs and flexing during use. These brackets, however, are somewhat complex, relatively costly to manufacture, and time consuming to install.

Other flexible web fencing systems are known as well. See, for example, U.S. Pat. Nos. 4,533,120; 3,233,870; and Italian patent No. 571,196.

In the present invention, a very simple and inexpensive system for attaching fence webbing or flexible rails to fence posts is disclosed which retains the advantages of brackets while eliminating many of the disadvantages. In this regard, it is to be remembered that fencing systems such as those disclosed in my prior patent are designed primarily to enclose livestock and other animals, such as horses, and, therefore, the strength not only of the webbing material, but the post connectors as well are of utmost importance.

In one exemplary embodiment of the invention, the improved fence post connector system of this invention includes an elongated, flexible strand which may comprise a single high tensile strength member made of wire, cable or the equivalent which may be, if desired, coated with a plastic or other suitable polymer composition. The coated wire is oriented substantially parallel with the fence post in overlying relationship to the web, so that the web extends between the wire and the post. Preferably, the plastic composition is of the same type from which the fencing material is made, for example, a polyvinyl chloride or other suitable plastic material. The metal wire is preferably 1/10" diameter steel wire (12½ gauge) having a tensile strength of approximately 240,000 pounds per square inch. It will be understood, however, that any wire, cable or the equivalent having suitable high tensile characteristics may be used. Moreover, it will be appreciated that other suitable materials may be utilized in the construction of the flexible elongated strand according to this invention.

The preferred coated wire strand is fastened to the post at either end by suitable fasteners, such as heavy-duty staples, or the like. The fasteners are preferably made of galvanized or stainless steels to ensure long life despite prolonged exposure to the elements. In one exemplary embodiment of the invention, one or more staples are driven into the post, straddling each of the free ends of the coated wire, so as to firmly fasten the wire to the post. Additional staples are applied just above and just below the web. These staples are driven into the post to a lesser extent than the endmost staples. This permits the web to move axially, i.e., in the direction of its elongation, to facilitate proper tensioning and to permit its inherent flexibility to be fully utilized.

It will be appreciated that where axial movement of the web or rail is neither required nor considered desirable, all of the staples or other fasteners may be driven into the fence post to a substantially uniform depth to firmly attach the web or rail to the post. In this regard, one or more fasteners may be driven through the web itself if so desired.

It is to be understood, of course, that the number of fence rails or webs secured to the post may vary as desired, usually from at least two to as many as six or more. In the preferred embodiment, the staples or other suitable fasteners are positioned to straddle the flexible strand and, preferably, driven into the post adjacent the upper and lower edges of each of the webs as described above.

In another exemplary embodiment, two individual strands, each comprising a plastic-coated high tensile strength wire, are applied in side-by-side relationship to each fence post for added strength.

In still another exemplary embodiment, a pair of high tensile strength wires are encapsulated in a single plastic strand which is fastened to the post in the same manner as described above.

As previously stated, the flexible connector strand may be constructed of suitable material other than plastic, and the high tensile wires need not be utilized if the strand itself has sufficient strength characteristics.

The staples or other fasteners used to secure the webs to the fence posts are, of course, sized to accommodate the described single or double wire strand arrangement. Staples are preferably provided with stop elements which limit the extent of penetration into the post. These are particularly suitable for use adjacent the upper and lower edges of the rails or webs where it is desirable to limit the penetration of the staples into the post so as to permit axial movement of the web. The staples may also be provided with serrated surfaces to further enhance the gripping power of the staples relative to the fence post, which is preferably made of wood.

In accordance with another aspect of the invention, the above-described fence web-to-post connection system is employed in a total fencing system which comprises at least one and preferably two or more flexible fencing webs which are attached to a plurality of fence posts extending about an area to be enclosed, and which also includes one or more web tensioning devices.

In a related aspect of the invention, a method of attaching one or more flexible fencing webs to a fence post comprises the steps of:

(a) orienting at least one flexible web of fencing material substantially horizontally with respect to the substantially vertical fence post;

(b) orienting at least one elongated, flexible strand generally parallel to the fence post and in overlying relationship to the at least one web, such that the web extends between the post and the strand; and (c) firmly fastening the strand to the post at a plurality of locations.

In a preferred method, the strand is firmly attached to the post at either end of the strand, and only loosely attached to the post at locations adjacent the upper and lower edges of the one or more webs to permit axial movement of the webs.

Accordingly, the present invention provides a strong, durable connection system for attaching flexible fencing webs to fence posts which constrains the individual webs against any significant vertical movement, and where desired, permits horizontal, axial movement of the web or webs relative to the post. The invention is further characterized by low cost, simplicity and ease of both manufacture and installation. Other objects and advantages will become apparent upon reading of the detailed description of the invention in conjunction with the accompanying drawings.

BRIEF DESCRIPTION OF THE DRAWINGS

FIG. 4 is a partial perspective view of a fence post and web connector system in accordance with an alternative embodiment of the invention;

FIG. 5 is a partial perspective view of a fence post and web connector system in accordance with still another embodiment of the invention;

FIG. 6 is a cross-sectional view of the connector strand illustrated in FIG. 5; and FIGS. 7A and 7B are side and top views, respectively, of a staple for use in the present invention.

DETAILED DESCRIPTION OF THE DRAWINGS

Figure 1:
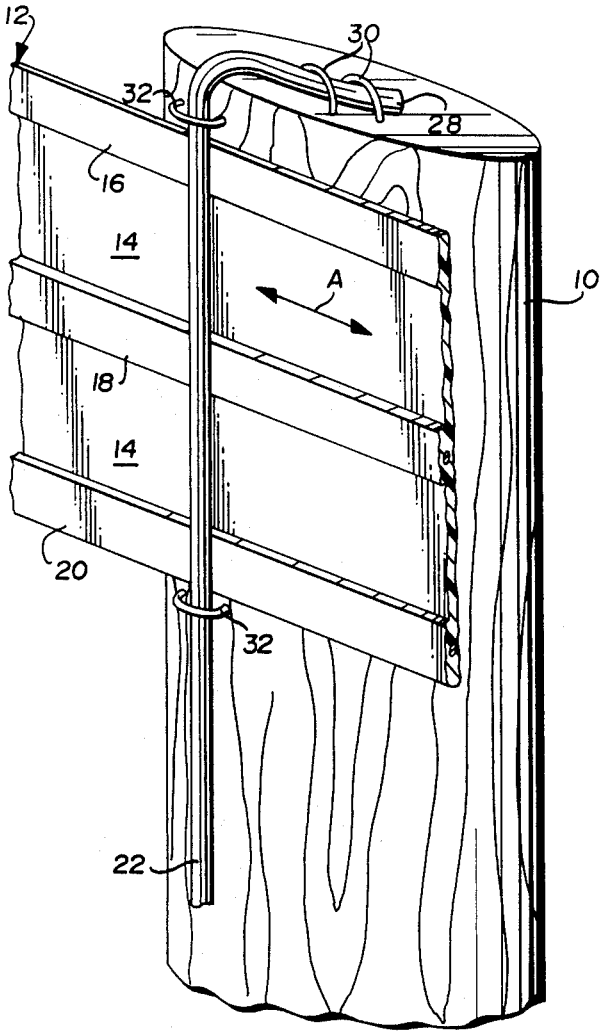
FIG. 1 is a partial perspective view of a fence post and web connector system in accordance with one exemplary embodiment of the invention.
Figure 2:
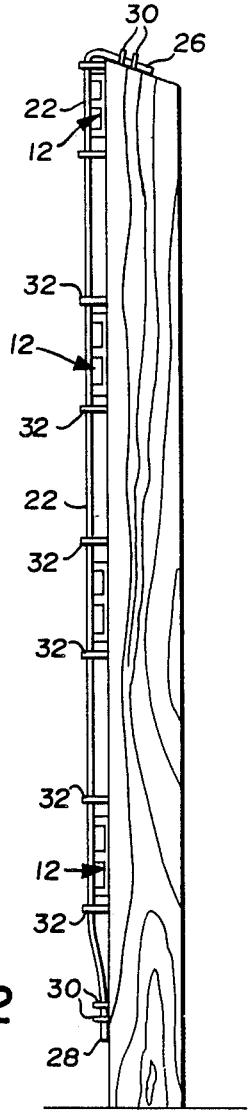
FIG. 2 is a partially schematic side elevational view of a fence post and multiple webs in accordance with the invention.

With reference now to FIGS. 1 and 2, a fence post 10, which is typically constructed of wood, is shown in a normal vertical orientation relative to a horizontally extending, flexible web or rail 12. The number of webs used in a fencing system, and the vertical spacing between the webs, may be varied as desired in accordance with end use requirements. Nevertheless, for purposes of this invention, at least one, and preferably more than one, web is attached to each fence post. The fencing web 12 includes intermediate, relatively thin web portions 14 and three, vertically spaced, thickened rib portions 16, 18 and 20, each of which encases a high tensile member, such as a steel wire. The fencing web 12 is preferably of the type disclosed in earlier issued U.S. Pat. No. 4,465,263, although the connector system of this invention may be used with other flexible webs as well.

Figure 3:
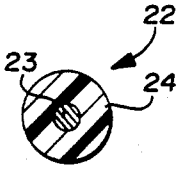
FIG. 3 is a cross-sectional view of a plastic-coated wire strand connector in accordance with the invention.

The one or more webs are secured to the fence post 10 by a flexible elongated strand 22 which, in a preferred embodiment best seen in FIG. 3, may uniformly dimensioned high tensile strength steel wire 23 coated with a plastic composition 24 which is preferably of a similar composition as the fence web material. For example, the plastic coating may be of a polyvinyl chloride composition, but other suitable plastic compositions may be employed as well. In addition, the high tensile wire may be of material other than steel, including non-metallic and, in those instances where the strand itself has the required strength characteristics, no high tensile wire need be employed.

The elongated strand 22 is fastened at its upper and lower free ends 26, 28, respectively, by one or more fasteners such as staples 30. Two such staples are shown at each end of the strand in FIG. 2 for exemplary purposes only. One, or more than one staple may be used at each end as desired. At least two additional staples are used in this preferred embodiment, one just above the upper edge of the fence web 14 adjacent rib 16, and the other just below the fencing web 14 adjacent the lower rib 20. The staples which attach the upper and lower free ends of the stand 22 to the fence post are driven into firm engagement with the strand 22 so as to fixedly secure the strand to the post. On the other hand, staples 32 which are located adjacent upper and lower edges of the web 12, are driven to the post somewhat loosely, i.e., to a lesser degree than staples 30 so that lateral movement of the web 12 in the direction of elongation of the web (indicated by arrow A in FIG. 1) is permitted, thereby enabling adjustment of the tension in the web, as well as flexing from externally applied forces, such as by contact with livestock enclosed in a fenced area. A similar arrangement is provided for each of the webs fixed to the fence post.

In FIG. 4, there is illustrated an alternative embodiment of the invention which is similar in all respects to the FIG. 1 embodiment with the exception that a second strand 22 is attached to the fence post in side-by-side relationship to the first strand. This arrangement provides added strength where necessary or required, depending, for example, on whether the stock enclosed by the fence are relatively active or relatively inactive.

Referring now to FIGS. 5 and 6, another alternative embodiment of the invention is disclosed wherein like reference numerals are utilized to indicate elements in common with the FIGS. 1 and 4 embodiments. In this embodiment, a relatively wide elongated, and uniformly dimensioned flexible strand 34 is utilized to attach the web or webs 12 to the fence post 10. The elongated strand 34 encases a pair of high tensile strength steel wires 36, as best seen in FIG. 6. A typical width dimension for the strand 34 would be approximately one inch although this dimension may be varied as desired.

The strand 34 is attached to the fence post in a manner similar to the manner in which strand 22 is attached to the post. Staples 38 are driven into firm engagement with the post at the upper and lower free ends of the strand 34 while staples 40 are driven somewhat loosely into the post on either side of the strand 34 to permit lateral, or axial movement of the web.

It will be understood that with respect to the structural arrangements shown in any one of FIGS. 1, 3, 4 and 5, that fasteners other than staples may be used, and, where axial movement of the one or more webs is not required and/or considered desirable, the fasteners may all be uniformly driven into engagement with the post to firmly fix the webs or rails thereto. Moreover, the fasteners may be driven through the web or rail itself if so desired.

FIGS. *7a* and *7b* illustrate an exemplary staple construction particularly useful in the present invention. The staple 40 includes a base portion 42, and a pair of substantially parallel leg portions 44. Each leg 44 has a substantially semi-circular stop element 46 attached thereto by any suitable means. These elements serve as physical as well as visual indicators that the staple has been driven into the fence post to the required penetration depth. This is especially useful when driving staples adjacent the upper and lower edges of the fence webs, the stops 46 being positioned so that when the stops 46 engage the post, there is sufficient play in the strand 34 permitting the web 12 to move laterally in a direction substantially perpendicular to the strand. It will also be noted that the exterior surface of the staple can be serrated to provide better gripping action with respect to the preferably wooden fence post.

With respect to each of the above described embodiments, it will be understood that the number of fence webs, and number of elongated strands 22 or 34 associated with any given fence post may be varied as desired. In addition, it will be appreciated that with the present fence post connector system, the upper most fence web 12 may be located closely adjacent the top surface of the fence post as shown in FIGS. 1 and 2. This is because the connector strands may extend over, and be attached to the top surface of the post, requiring no additional space along the fence post as in the case of brackets of the type used in prior art constructions. Of course, the web may also be located below the top surface of the fence post, as illustrated in FIGS. 4 and 5, if so desired.

While the invention has been described in connection with what is presently considered to be the most practical and preferred embodiment, it is to be understood that the invention is not to be limited to the disclosed embodiment, but on the contrary, is intended to cover various modifications and equivalent arrangements included within the spirit and scope of the appended claims.

I claim:

1. A method of attaching a flexible web of substantially horizontally extending fencing material to a substantially vertical fence post so that said web is constrained to substantially prevent vertical movement of the web but to allow horizontal movement thereof, the method comprising the steps of:

(a) orienting at least one flexible web of fencing material substantially horizontally with respect to said substantially vertical fence post;

(b) orienting at least one flexible, elongated strand generally parallel to said fence post and in overlying relationship to said at least one web, such that said web extends between said post and said strand;

(c) firmly attaching said strand to said post at locations spaced from said at least one web; and (d) loosely attaching said strand to said post at locations adjacent upper and lower edges of said at least one web.

2. A method according to claim 1 wherein said at least one flexible, elongated strand comprises at least one high tensile strength member.

3. A method according to claim 1 wherein said high tensile strength member is coated.

4. A method according to claim 1 wherein said at least one flexible, elongated strand is attached at its upper end to a top surface of said fence post, and at its lower end to a vertical surface of said post remote from a lower edge of said at least one web.

5. A method according to claim 1 wherein at least two of said flexible, elongated strands are arranged substantially parallel on said fence post.

6. A method according to claim 1 wherein said at least one flexible, elongated strand comprises more than one high tensile strength member encapsulated within a single plastic strip.

7. A method according to claim 2 wherein said high tensile strength member is steel wire.

8. A method according to claim 1 wherein steps (c) and (d) are practiced using a plurality of staples.

9. A method according to claim 1 wherein at least two webs of fencing material are attached to said fence post.

10. A method according to claim 6 wherein said high tensile strength members are steel wire.

11. A method according to claim 1 wherein said flexible web comprises flexible plastic material and includes at least a pair of high tensile strength members extending along at least the upper and lower edges of said web, said members encased in said plastic material.

12. A method according to claim 1 wherein at least step (d) is practiced using staples provided with penetration stop elements.

13. A fence assembly comprising a plurality of substantially vertical, laterally spaced fence posts with at least one web of flexible fencing material extending therebetween, and including elongated, flexible strand means, including at least a pair of high tensile strength members encapsulated in a single plastic strip and extending substantially parallel to each of said posts for attaching said at least one web to each of said posts so that said at least one web is constrained against vertical movement but free to move horizontally relative to said posts.

14. A fence assembly as defined in claim 13 wherein said elongated flexible strand means is firmly affixed to said fence posts at upper and lower ends of said strand means, with said web extending between said post and said strand means, in a direction substantially perpendicular to said post and said strand means.

15. A fence post assembly as defined in claim 14 wherein said flexible strand means is relatively loosely affixed to said fence post at locations adjacent upper and lower edges of said at least one flexible web.

16. A fence post assembly as defined in claim 14 wherein the upper end of said strand means is affixed to the fence post top surface.

17. A fence post assembly as defined in claim 13 and further including fastener means for attaching said strand means to said post.

18. A fence post assembly comprising a plurality of substantially vertical, laterally spaced fence posts with at least one web of flexible fencing material extending therebetween, and including elongated, flexible strand means extending substantially parallel to each of said posts for attaching said at least one web to each of said posts so that said at least one web is constrained against vertical movement but free to move horizontally relative to said posts wherein said web of flexible fending material comprises a length of flexible plastic material, and wherein said web and said strand each encase at least one high tensile strength member.

19. A fence post assembly as defined in claim 18 wherein said web and said strand each encase at least two high tensile strength members.

20. A fence post assembly comprising a plurality of substantially vertical, laterally spaced fence posts with at least one web of flexible fencing material extending therebetween, and including elongated, flexible strand means extending substantially parallel to each of said posts for attaching said at least one web to each of said posts so that said at least one web is constrained against vertical movement but free to move horizontally relative to said posts;

wherein said elongated flexible strand means is firmly affixed to said fence posts at upper and lower ends of said strand means, with said web extending between said post and said strand means, in a direction substantially perpendicular to said post and said strand means;

wherein said flexible strand means is relatively loosely affixed to said fence post at locations adjacent upper and lower edges of said at least one flexible web; and wherein said flexible strand is affixed to said fence posts by a plurality of fasteners, and wherein said fasteners are driven into firm engagement with said strand at said upper and lower ends of said strand, and into relatively loose engagement with said strand at said locations adjacent the upper and lower edges of said at least one flexible web.

21. A fence comprising, in combination, a plurality of fence posts, at least one elongated web of plastic material having spaced, substantially parallel edges along its length, and a relatively flat intermediate portion, each edge having an enlarged cross-section relative to said intermediate portions, and encasing a high tensile member; support means for holding said web on each of said fence posts; said support means comprising, for each post, at least one elongated, uniformly dimensioned flexible strand member extending substantially parallel to said fence post and fixed to said post at opposite ends thereof, and a plurality of fasteners connecting said strand member to said post adjacent at least upper and lower edges of said at least one web.

22. A fence as defined in claim 21 wherein said fasteners comprise staples.

23. A fence as defined in claim 22 wherein said staples have serrated surfaces.

24. A fence as defined in claim 23 wherein said staples are provided with penetration stop elements.

25. In a fencing system comprising a plurality of fence posts and at least one elongated web extending between and substantially perpendicular to said plurality of fence posts, an improved connector system for attaching said web to each of said posts such that said web is free to move axially in the direction of elongation of the web, said connector system comprising, for each post, at least one elongated strand extending along the post and over said web, said at least one strand comprising at least one plastic-coated high tensile strength member, said strand firmly secured at either end to said post; and at least one pair of fasteners associated with each of said at least one web, said fasteners holding said strand against said post at locations adjacent upper and lower edges of said web, such that said web is free to move horizontally in the direction of elongation of the web.

26. A fencing system as defined in claim 25 wherein said at least one strand comprises at least a pair of high tensile strength members encased in a single plastic strip.

* * * * *